US007935210B2

(12) United States Patent
Schega et al.

(10) Patent No.: US 7,935,210 B2
(45) Date of Patent: May 3, 2011

(54) METHOD OF MAKING A LINER BAG FOR WATERLESS TOILET

(75) Inventors: Daniel Schega, Troisdorf (DE); Armin Meyer, Köln (DE)

(73) Assignee: Lemo Maschinenbau GmbH, Niederkassel-Mondorf (DE)

( * ) Notice: Subject to any disclaimer, the term of this patent is extended or adjusted under 35 U.S.C. 154(b) by 1323 days.

(21) Appl. No.: 11/448,607

(22) Filed: Jun. 7, 2006

(65) Prior Publication Data

US 2006/0272082 A1 Dec. 7, 2006

(30) Foreign Application Priority Data

Jun. 7, 2005 (DE) ..... 10 2005 026 358

(51) Int. Cl.

| | |
|---|---|
| ***B32B 37/00*** | (2006.01) |
| ***B32B 37/02*** | (2006.01) |
| ***B32B 38/04*** | (2006.01) |
| ***A47K 11/00*** | (2006.01) |
| ***A47K 11/06*** | (2006.01) |
| ***B29C 65/02*** | (2006.01) |

(52) U.S. Cl. ..... 156/251; 156/552; 156/553; 4/483; 4/484

(58) Field of Classification Search ..... 383/33, 383/34, 37; 429/535; 427/115; 4/483, 484; 156/251, 552, 553

See application file for complete search history.

(56) References Cited

U.S. PATENT DOCUMENTS

| | | | | |
|---|---|---|---|---|
| 4,354,335 | A * | 10/1982 | Meyer | 53/475 |
| 6,532,605 | B1 * | 3/2003 | Howell | 4/484 |
| 2002/0132070 | A1 * | 9/2002 | Franzen et al. | 428/35.2 |

* cited by examiner

*Primary Examiner* — Mark A Osele
*Assistant Examiner* — Nickolas Harm
(74) *Attorney, Agent, or Firm* — Andrew Wilford

(57) ABSTRACT

A waterless-toilet liner has a seat panel adapted to lie atop a waterless-toilet seat and formed with a central hole of a size and shape generally corresponding to a size and shape of the hole of the seat, and a bag having an upper rim secured to the seat panel around the hole therein. This liner is made by first advancing a foil tube to a first work station and forming a cross-seam and cut in the foil tube-to cut therefrom a bag having an open end. Then the open end of the bag is fitted between a pair of foil sheet. An opening is cut through the foil sheets and open end of the bag and the edges of the bag at the opening and there adjacent are bonded to the foil sheets. Then the foil sheets are cut through or perforated downstream of the bag.

8 Claims, 6 Drawing Sheets

METHOD OF MAKING A LINER BAG FOR WATERLESS TOILET

FIELD OF THE INVENTION

The present invention relates to a liner for a waterless toilet. More particularly this invention concerns a liner bag and method of making it.

BACKGROUND OF THE INVENTION

A standard water-flush toilet has an upwardly open bowl provided with a seat for the user. Waste is carried off from inside the bowl by a flush using at least several liters of water.

In many situations such a water flush is not possible. This is the case in regions where water is in very short supply, in applications where the weight of the flush water cannot be managed (such as on moving vehicles, e.g aircraft), and where the toilet is only needed for temporary use and a water hookup is not available.

A standard waterless toilet uses a liner tube or bag, and is described in U.S. Pat. Nos. 3,619,822 and 6,052,842. Such toilets have a holder below and outside the bowl for a large-diameter tube of stretchable plastic, e.g. polyethylene. The tube is guided up and over the seat, then down into the bowl and out through an opening at the bottom of the bowl. Spreaders are provided inside the bowl to hold the tube open below the seat, and other guides pinch the bag shut at the bottom of the bowl above the opening. The-user thus sits on the bag where it passes over the seat and waste drops into the section of tube underneath the seat. After use the waste-containing section and tube part atop the seat is pulled downward and pinched of to seal in the waste and provide a fresh seating surface for the next user.

Such a system is fairly effective, but is complex and requires the use of a fairly expensive toilet system. furthermore the disposable bag-forming tube is quite expensive also.

OBJECTS OF THE INVENTION

It is therefore an object of the present invention to provide an improved liner bag for a waterless toilet.

Another object is the provision of such an improved liner bag for a waterless toilet that overcomes the above-given disadvantages, in particular that is of simple and inexpensive construction.

Yet another object is the provision of an improved method of making such a liner.

SUMMARY OF THE INVENTION

A waterless-toilet liner has according to the invention a seat panel adapted to lie atop a waterless-toilet seat and formed with a central hole of a size and shape generally corresponding to a size and shape of the hole of the seat, and a bag having an upper rim secured to the seat panel around the hole therein.

This liner is made by first advancing a foil tube to a first work station and forming a cross-seam and cut in the foil tube to cut therefrom a bag having an open end. Then the open end of the bag is fitted between a pair of foil sheet. An opening is cut through the foil sheets and open end of the bag and the edges of the bag at the opening and there adjacent are bonded to the foil sheets. Then the foil sheets are cut through or perforated downstream of the bag.

The object of the invention is thus attained by providing a plastic foil bag consisting of a first foil section covering the toilet seat and provided with a hole corresponding to the inner perimeter of the toilet seat and a continuous second foil section completely lining the toilet bowl. Due to the design of the plastic bag according to the invention a form-fit to the toilet bowl of the plastic foil bag is now possible and hence a complete use of the toilet bowl underneath the toilet seat is guaranteed. The plastic foil bag according to the invention has a very simple design and therefore can be produced at low costs.

Thanks to the described method steps it is now possible to produce a plastic foil bag with high efficiency and minimal effort. Furthermore the method is advantageously and easily adaptable to most different toilet forms or toilet requirements, so that a flexible method for the production of plastic foil bags is provided.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
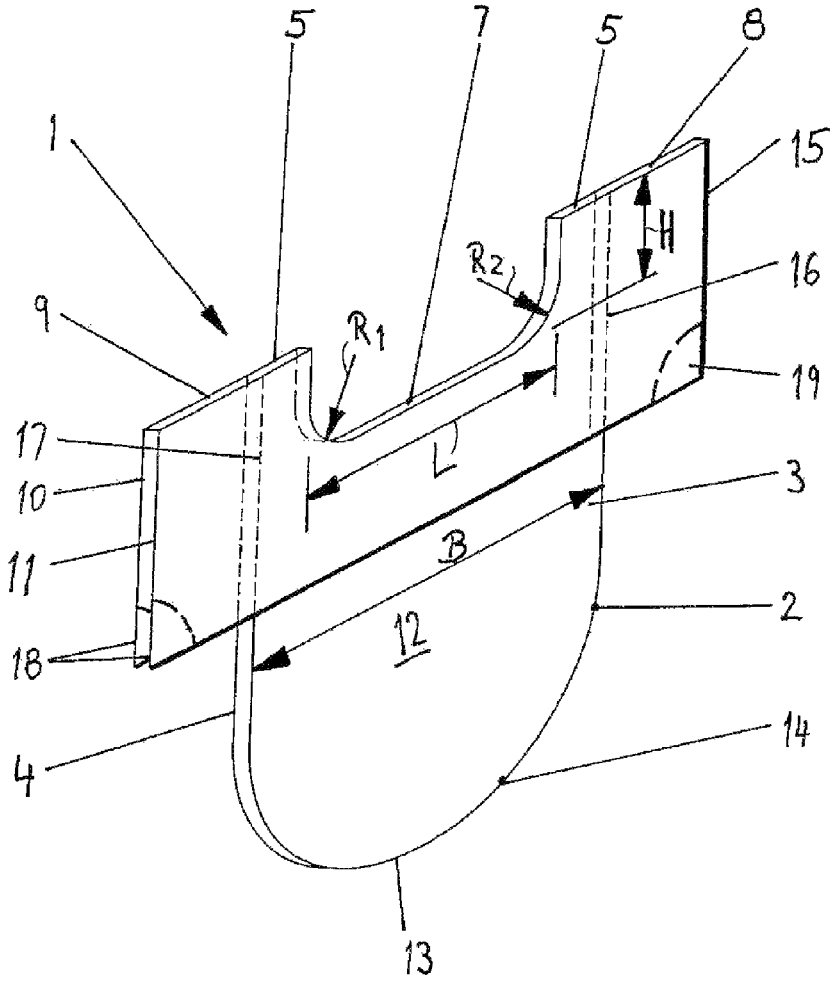
FIG. 1 is a perspective view of a waterless-toilet liner according to the invention.

As seen in FIG. 1 a plastic foil liner 1 is shown three-dimensionally. The plastic liner 1 consists of a bag 2 having a front panel 3 and a rear panel 4. At its upper end the bag 2 has an edge seam 5 and a hole 7 shaped like the inner edge of a toilet seat 29 (see FIG. 8). In the area of the bag edge seam 5 and the hole 7 the bag 2 is welded to a plastic foil sheet or seat panel that has two flaps 10 and 11. In one design the plastic foil sheet is designed as one single piece forming both flaps 10 and 11. In a further preferred design of the invention the plastic foil sheet is composed of two separate foil sheets 10 and 11 bonded together at seams 8 and 9 forming continuations of the seams 5. If the two flaps 10 and 11 are formed by a single foil, there are no seams 8 and 9, just a fold in this area.

The bag 2 is preferably made from a foil tube 12 so that the front panel 3 and the rear panel 4 of the bag 2 are one piece. The foil tube 12 is provided made in this shape in a separation welding procedure so that the bag 2 has a U-shaped welded seam 14 on its lower end 13. The weld seam 14 thus forms the bag bottom.

The hole 7 is cut with two different radiuses R1 and R2 from the bag 2 so that when open the bag 2 fits complementarily in a toilet bowl 30 (FIG. 8) that typically has an angled wall and a straight wall. By choosing the radiuses R1 and R2 as well as length L and height H, the hole 7 can have the shape of any standard toilet bowl 30, waterless or standard.

The foil sheets 10 and 11 form a seat panel that, if unfolded, can be spanned over a toilet seat 29 to completely cover its inner edge and upper surface. In a further design of the invention this seat panel 10, 11 is of such length that the foil sheets 10, 11 extend well past the outer periphery of the toilet seat 29 and can be fixed over the toilet seat 29 or the toilet itself by means of an appropriate device or clip. If the seat panel is unfolded, the hole 7 forms an opening corresponding to the inner perimeter of the toilet seat 29 so that the full hole width and breadth of the toilet seat 29 are available for the user. Due to this design and exact adaptation of the hole 7 to a toilet seat 29 the hole does not reduce the perimeter of the seat 29.

As illustrated in FIG. 1 a width B of the bag 2 exceeds the length L of the hole 7. This extra width B of the bag 2 guarantees that the complete toilet bowl 30 is lined by the bag 2. In particular the part underneath the toilet seat 29 is also lined. Assuming that the plastic foil liner 1 with its end 15 is pulled over the front rim of the toilet seat 29, the end 16 of the bag 2 is drawn under the toilet seat 29 and thus enlarges the perimeter of the bag 2 so that the bag 2 underneath the toilet seat 29 has a larger perimeter than the hole 7. For this effect the perimeter of the hole 7 corresponds to the inner perimeter of the toilet seat 29. As shown in FIG. 1 the front area 16 and the rear area 17 of the bag 2 can be enlarged. This is of particular advantage for filling and using the entire volume of the toilet bowl 30. A bag 2 designed according to the invention and illustrated in FIG. 1 therefore offers the advantage that the whole area of the toilet bowl 30 can be used. Thanks to the design or coverage of the width B of the bag 2 as well as to the shape of the weld seam 14, The bag 2 has a shape corresponding to the toilet bowl 30.

According to the invention it is furthermore conceivable that cutouts 18 and 19 could be cut in the foil flaps 10 and 11 necessary for a fully automatic transportation or handling or fitting of the plastic foil liner 1. The cutouts 18 and 19 are illustrated as a dotted lines. Of course it is furthermore conceivable to create other recesses, cut into the flaps 10 and 11 for instance by means of punching. Thus the foil flaps 10 and 11 can be formed with holes, perforations or combinations of holes and punchouts 18 and 19.

Figure 8:
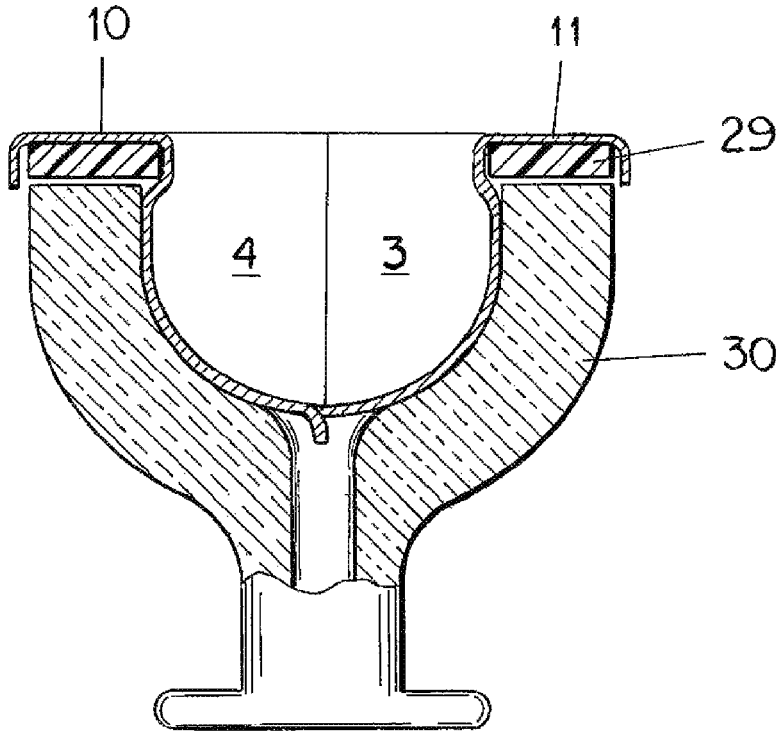
FIG. 8 is a vertical section through a toilet fitted with a liner according to the invention.

The seat panel formed by the foil flaps 10 and 11 according to the invention is laid as shown in FIG. 8 over the toilet seat 29 and can be stretched tight. This fitting causes the second foil section composed of the bag 2 to fit in the toilet bowl 30 underneath the toilet seat 29. Due to the specific design according to the invention, the bag 2 completely lines and covers the toilet bowl 30 and is lies against its inner surface. After use, the plastic foil liner 1 can be either closed manually or be sucked down into the toilet as a whole. The plastic is the same as that used in known foils bags or biodegradable plastic foils.

Figures 2A, 2B:
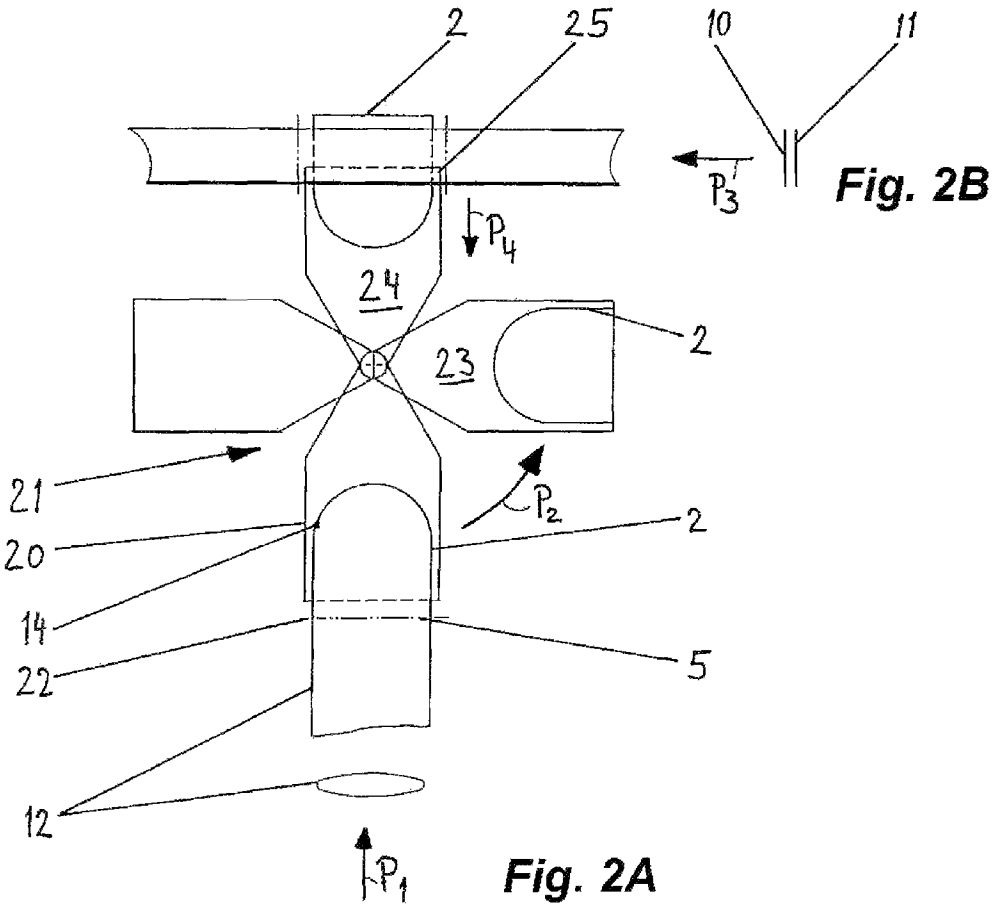
FIG. 2A is a largely schematic top view illustrating manufacture of the liner of FIG. 1.
FIG. 2B is an end view of a detail of FIG. 2*a*

FIGS. 2A and 2B schematically illustrate a top view of a fabrication procedure for a plastic foil liner 1 according to the invention. The plastic tube 12 is fed in the direction of arrow P1 to the holder 20 of a device 21 which is part of the production machine. The holder 20 is for instance composed of a suction plate or a mold part. In this production step the foil tube 12 which can also be composed of a double layer foil is welded to the holder 20 such that the welding seam 14 is formed. Dependent on the shape of the toilet bowl 30, the welding seam 14 can have a different shape. The excess material of the foil tube 12 which is not needed after the welding is for instance vacuumed up or otherwise disposed of. At the same time the bag 2 is separated from the foil tube 12 by means of a cutter or knife along the cut line edge 22 so that the bag edge 5 is formed.

The holder 20 now swings in the direction of arrow P2 in an angle which can be set by the device 21 into another work station 23. In this station 3 the weld seam 14 is advantageously cooled. This cooling can for example be effected by compressed air. It is explicitly pointed out that although FIG. 2A shows a 90° angle, bigger or smaller angles are obviously conceivable as well, dependent on the equipment design or the configuration of the device.

In a following work step the holder 20 swings into the next work station 24, again in the direction of arrow P2. The bag 2 therefore is moved into position between the foil flaps 10 and 11 and even extends past these sheets 10 and 11 in some areas.

The foil flaps 10 and 11 are constantly fed in the direction of arrow P3. To allow a welding of the foil flaps 10 and 11 to the bag 2 it is conceivable for the holder 20 of the device 21 to telescope. In this connection the holder 20 or a front edge area 25 of the holder 20 extends out between the foil sheets 10 and 11 in the direction of arrow P4 so that the foil sheets 10 and 11 and the bag 2 lie one upon the other without the holder 20. At this point two alternative fabrication methods for the creation of the hole 7 and the bag edge 5 can be carried out. Thus it is conceivable according to the invention that a fan-shaped, openable welding plate is inserted between the front part 3 and the rear part 4 of the bag 2 and that the welding of the bag edge 5 and the hole 7 is carried out in one work step. The alternative is to carry out the welding of the bag edge 5 and the hole 7 in two work steps. In this connection a simple welding plate surrounding the hole 7 is at first put between the front panel 3 and the rear panel 4 with the bag 2 and the front panel 3 is welded to foil sheet 11 as well as the rear panel 4 is welded to the foil sheet 10. In a following not illustrated work step the bag edge 5 and the exterior seams 8 and 9 are formed.

Figure 3:
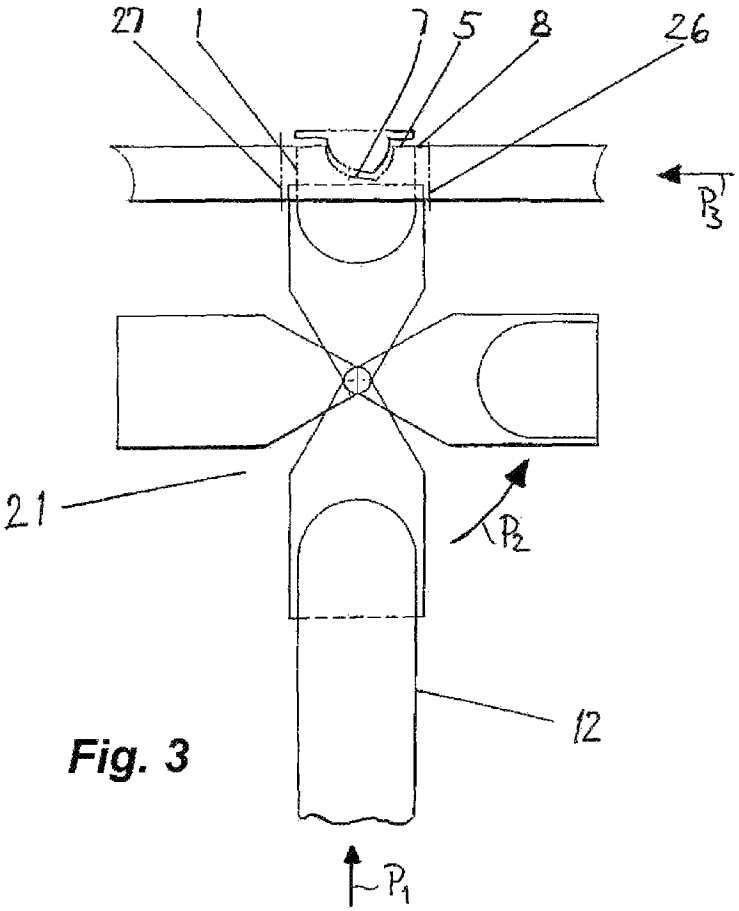
FIG. 3 is a view like FIG. 2A illustrating further steps in the manufacture of the liner in accordance with the invention.

In a last production step to complete the plastic foil liner 1 an at least partial separation of the foil sheets 10 and 11 in the areas 26 and 27 takes place or, dependent on the fabrication, respectively only in area 27, as shown in FIG. 3A. Furthermore the punching of the foil sheets can be carried out during this work step.

Figure 4B:
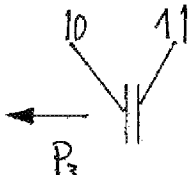
FIG. 4B is an end view of a detail of FIG. 4A.
Figure 4A:
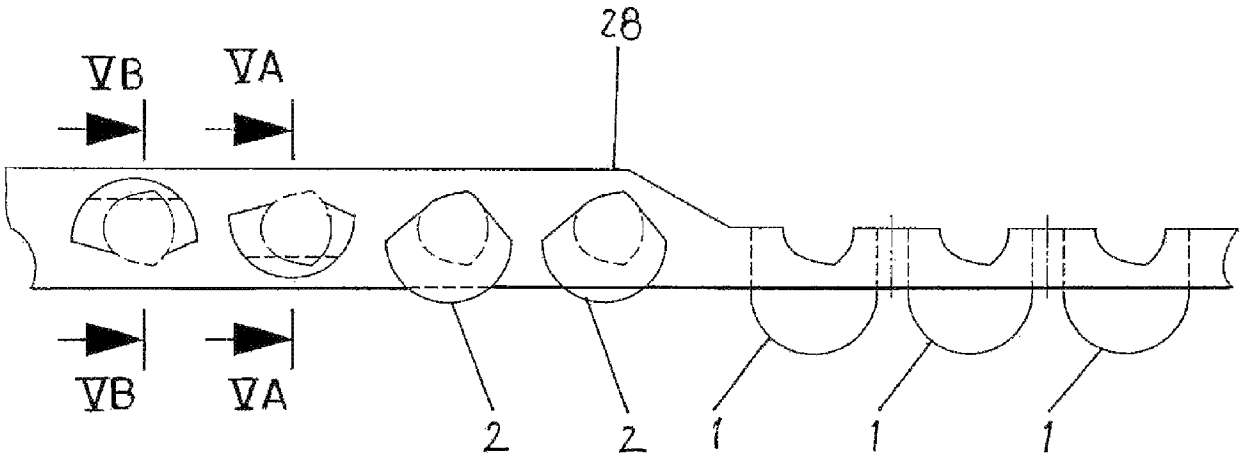
FIG. 4A is a view like FIG. 3 showing further steps in the manufacture of the liner.
Figures 5A, 5B:
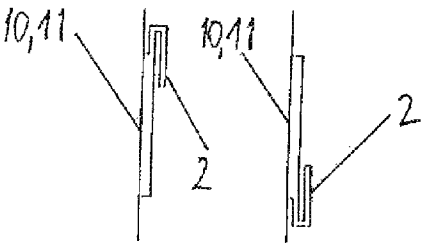
FIGS. 5A and 5B are sections taken respectively along lines VA-VA and VB-VB of FIG. 4A.
Figures 7A, 7B:
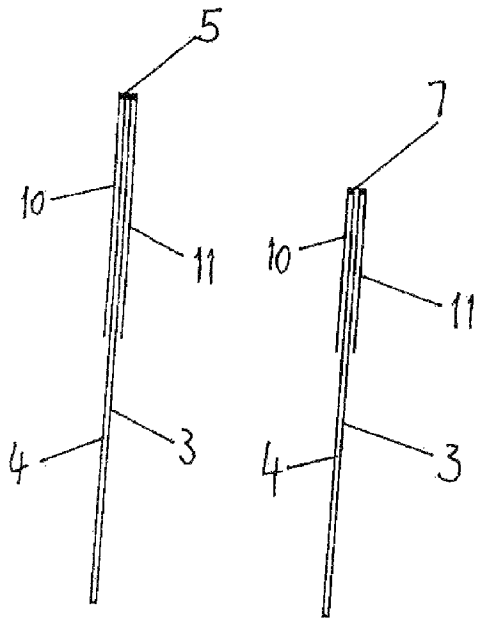
FIGS. 7A and 7B are sections taken along respective lines VIIA-VIIA and VIIB-VIIB.

In FIG. 4A the fabrication procedure after the welding process and separation up to the rolling up is illustrated. The now completed plastic foil bags 1 have the plastic foil flaps 10 and 11 running parallel to each other and one upon the other. In a now following work step the plastic seat panel is unfolded, as illustrated at 28. For an even winding up of the plastic foil sheets on a core or spool the bag 2 lying on the plastic seat panel is folded at first on one side of the plastic seat panel and subsequently to the other side of the plastic seat panel. The thus folded bags 2 with the attached plastic seat panel are illustrated in a crosscut section as shown by the sectional views of FIGS. VA and VB. This folding according to the invention on the one hand guarantees that the winding core is always evenly thick on both sides and on the other hand that the bag 2 cannot get under the plastic foil flaps 10 and 11 while being pulled over the toilet seat 29 and therefore cannot fall into the toilet bowl 30. The folding thus ensures that the bag 2 hangs down perfectly into the toilet. The downward deployment of the bag 2 can be enforced by compressed air.

Figure 6:
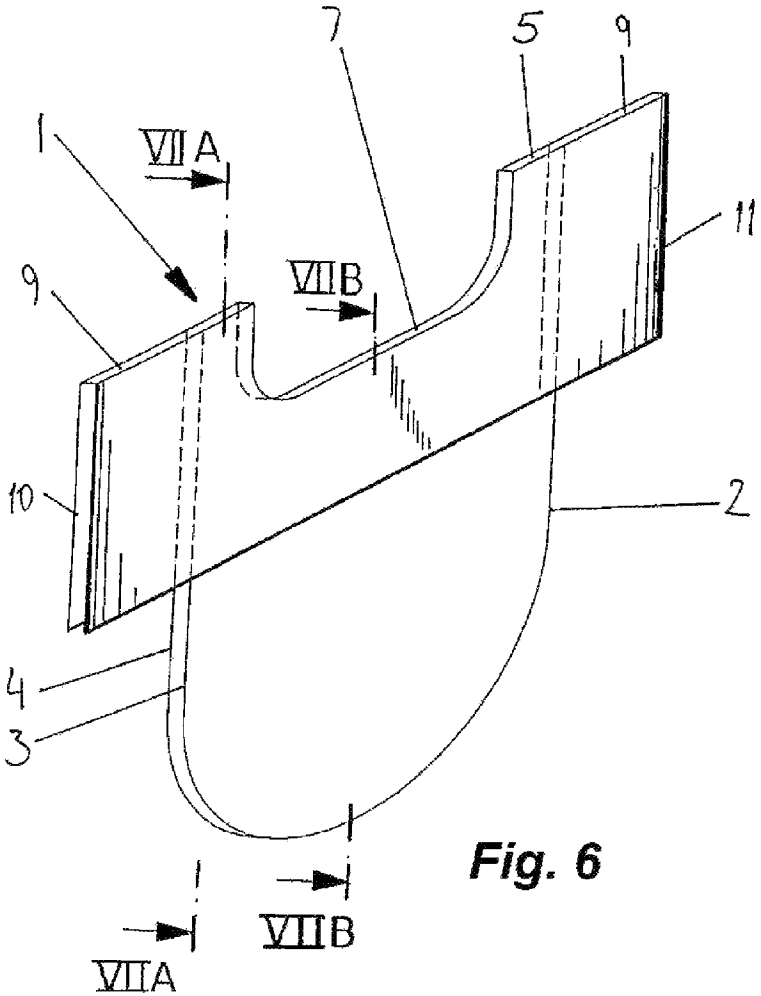
FIG. 6 is a perspective view of another liner according to the invention.

For reasons of clarification FIG. 6 shows another three-dimensional illustration of a plastic foil liner 1 according to the invention. The sections of FIGS. VIIA and VIIB again clearly show the welding seam and the plastic foil liner 1. Even though this example only shows the production of a plastic foil liner 1 with the help of a foil tube 12 and two separate foil flaps 10 and 11 it is conceivable according to the invention that also the front panel 3 and the rear panel 4 of the bag 2 are produced out of separate plastic fold sheets. It is equally conceivable that the seat panel composed of foil sheets 10 and 11 could be composed of a folded foil section.

It is of course furthermore possible to completely separate the foil sheets during the production and to subsequently arrange them in piles or respectively one upon the other on a mandrel.

We claim:

1. A method of making a waterless-toilet liner, the method comprising the steps of:

a) advancing a foil tube to a first work station;

b) forming a cross-seam and cut in the foil tube to cut therefrom a bag having an open end;

c) fitting the open end of the bag between a pair of foil sheets;

d) cutting a hole through the pair of foil sheets and through the open end of the bag to form adjacent bag and foil-sheet edges and bonding each of the bag edges at the hole to the adjacent foil-sheet edge to form seams at the edges; and e) cross cutting through the foil sheets downstream of the bag.

2. The liner-making method defined in claim 1, further comprising between steps b) and c) the step of:

cooling the cross-seam.

3. The liner-making method defined in claim 1, further comprising the step of welding the open bag end to the sheets around the hole.

4. The liner-making method defined in claim 1 wherein the bag has a pair of panels each having a respective one of the bag edges, step d) comprising the substeps of first bonding the edge of each of the panels of the bags to a respective one of the sheets and then bonding each of the sheets to the respective panel to each side of the respective hole.

5. A method of making a waterless-toilet liner, the method comprising the steps of:

a) advancing a foil tube to a first work station;

b) forming a cross-seam and cut in the foil tube to cut therefrom a bag having an open end;

c) fitting the open end of the bag between a pair of foil sheets;

d) cutting a hole through the pair of foil sheets and through the open end of the bag to form adjacent bag and foil-sheet edges and bonding each of the bag edges at the hole to the adjacent foil-sheet edge to form seams at the edges;

e) cross cutting through the foil sheets downstream of the bag; and f) folding one of the sheets at the hole so as to extend away from the other sheet and such that the sheets lie generally parallel to each other.

6. The liner-making method defined in claim 5, further comprising after step f) the step of g) rolling up the sheets and bags.

7. The liner-making method defined in claim 5, further comprising after step f) the step of:

folding the bags alternately from one side to another.

8. The liner-making method defined in claim 5, further comprising after step e) the steps of separating each of the bags and the respective sheets from the adjacent bag and respective sheets to form a plurality of liners; and stacking the liners.

* * * * *